US012256821B1

(12) United States Patent
Garey et al.

(10) Patent No.: US 12,256,821 B1
(45) Date of Patent: Mar. 25, 2025

(54) SCALP APPLICATOR

(71) Applicants: Colleen Garey, Lake Mary, FL (US); Keesha Morgan, Lake Mary, FL (US)

(72) Inventors: Colleen Garey, Lake Mary, FL (US); Keesha Morgan, Lake Mary, FL (US)

( * ) Notice: Subject to any disclaimer, the term of this patent is extended or adjusted under 35 U.S.C. 154(b) by 568 days.

(21) Appl. No.: 17/583,362

(22) Filed: Jan. 25, 2022

Related U.S. Application Data

(63) Continuation-in-part of application No. 17/164,894, filed on Feb. 2, 2021, now Pat. No. 11,707,125.

(51) Int. Cl.
*A45D 19/02* (2006.01)
*A45D 19/00* (2006.01)

(52) U.S. Cl.
CPC .... *A45D 19/026* (2021.01); *A45D 2019/0033* (2013.01)

(58) Field of Classification Search
CPC ..... A45D 19/026; A45D 2019/0033
See application file for complete search history.

(56) References Cited

U.S. PATENT DOCUMENTS 3,477,447 A 11/1969 Eldredge
4,213,473 A 7/1980 Dawson
4,309,119 A * 1/1982 Wittersheim ..... A45D 19/026 401/176
4,462,413 A * 7/1984 Schmitz ..... A45D 19/026 132/113
4,592,376 A * 6/1986 Sigmund ..... A45D 19/026 132/112
4,597,683 A * 7/1986 Wittersheim ..... A45D 34/042 401/39
5,054,504 A 10/1991 Winrow
5,311,887 A 5/1994 Ramsey
5,913,314 A 6/1999 Garrett
6,012,462 A * 1/2000 Schmittou ..... A45D 19/026 132/212
6,035,806 A 3/2000 Lorenzo
6,168,335 B1 * 1/2001 Mears ..... A46B 11/0017 401/118
D450,884 S 11/2001 Yoshida
6,357,450 B1 * 3/2002 Paice ..... A45D 19/026 222/137
D614,818 S * 4/2010 Moore ..... D30/158
8,668,400 B2 * 3/2014 Ecker ..... A01K 13/003 222/91
2007/0086963 A1 * 4/2007 Stern ..... A45D 19/026 8/405

(Continued)

FOREIGN PATENT DOCUMENTS

EP 1002477 5/2000
JP 2005126146 A * 5/2005 ..... A45D 19/02

*Primary Examiner* — Nicholas D Lucchesi
(74) *Attorney, Agent, or Firm* — Kyle A. Fletcher, Esq.

(57) ABSTRACT

The scalp applicator comprises an applicator comb, a snapping cap, a solution container, and a pair of finger rests. The scalp applicator is configured for use with a liquid phase cosmetic media. The scalp applicator may be a tool that is adapted to apply the liquid phase cosmetic media to a scalp of a patient. The pair of finger rests may be adapted to be pulled by a user's fingers while a user holds the solution container. Pulling the pair of finger rests may activate a pump to force the liquid phase cosmetic media from the solution container through the applicator comb onto the scalp of the patient.

17 Claims, 6 Drawing Sheets

(56) References Cited

U.S. PATENT DOCUMENTS

| | | | | |
|---|---|---|---|---|
| 2007/0136958 | A1* | 6/2007 | Draghiceanu | A45D 40/24 8/405 |
| 2010/0132730 | A1* | 6/2010 | Jung | A46B 11/0065 401/269 |
| 2010/0313903 | A1* | 12/2010 | Alazet | A45D 19/026 132/114 |
| 2021/0227947 | A1* | 7/2021 | Kreiss | A45D 24/22 |
| 2023/0270228 | A1* | 8/2023 | Flink | A46B 11/0013 132/114 |

* cited by examiner

SCALP APPLICATOR

CROSS REFERENCES TO RELATED APPLICATIONS

This application is a continuation-in-part of U.S. application Ser. No. 17/164,894, filed Feb. 2, 2021, which is incorporated by reference herein in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of hair care equipment and scalp therapy, more specifically, a scalp applicator.

SUMMARY OF INVENTION

The scalp applicator comprises an applicator comb, a snapping cap, a solution container, and a pair of finger rests. The scalp applicator is configured for use with a liquid phase cosmetic media. The scalp applicator may be a tool that is adapted to apply the liquid phase cosmetic media to a scalp of a patient. The pair of finger rests may be adapted to be pulled by a user's fingers while a user holds the solution container. Pulling the pair of finger rests may activate a pump to force the liquid phase cosmetic media from the solution container through the applicator comb onto the scalp of the patient.

An object of the invention is to apply a liquid phase cosmetic media to the scalp of a patient.

Another object of the invention is to provide to a pump to pump the liquid phase cosmetic media from a solution container when the pump is compressed by pulling on finger rests while holding the solution container.

A further object of the invention is to provide a manifold to distribute the cosmetic media to a plurality of hollow teeth.

Yet another object of the invention is to provide a snag free tip on the distal end of each of the plurality of teeth.

These together with additional objects, features and advantages of the scalp applicator will be readily apparent to those of ordinary skill in the art upon reading the following detailed description of the presently preferred, but nonetheless illustrative, embodiments when taken in conjunction with the accompanying drawings.

In this respect, before explaining the current embodiments of the scalp applicator in detail, it is to be understood that the scalp applicator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the scalp applicator.

It is therefore important that the claims be regarded as including such equivalent construction insofar as they do not depart from the spirit and scope of the scalp applicator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
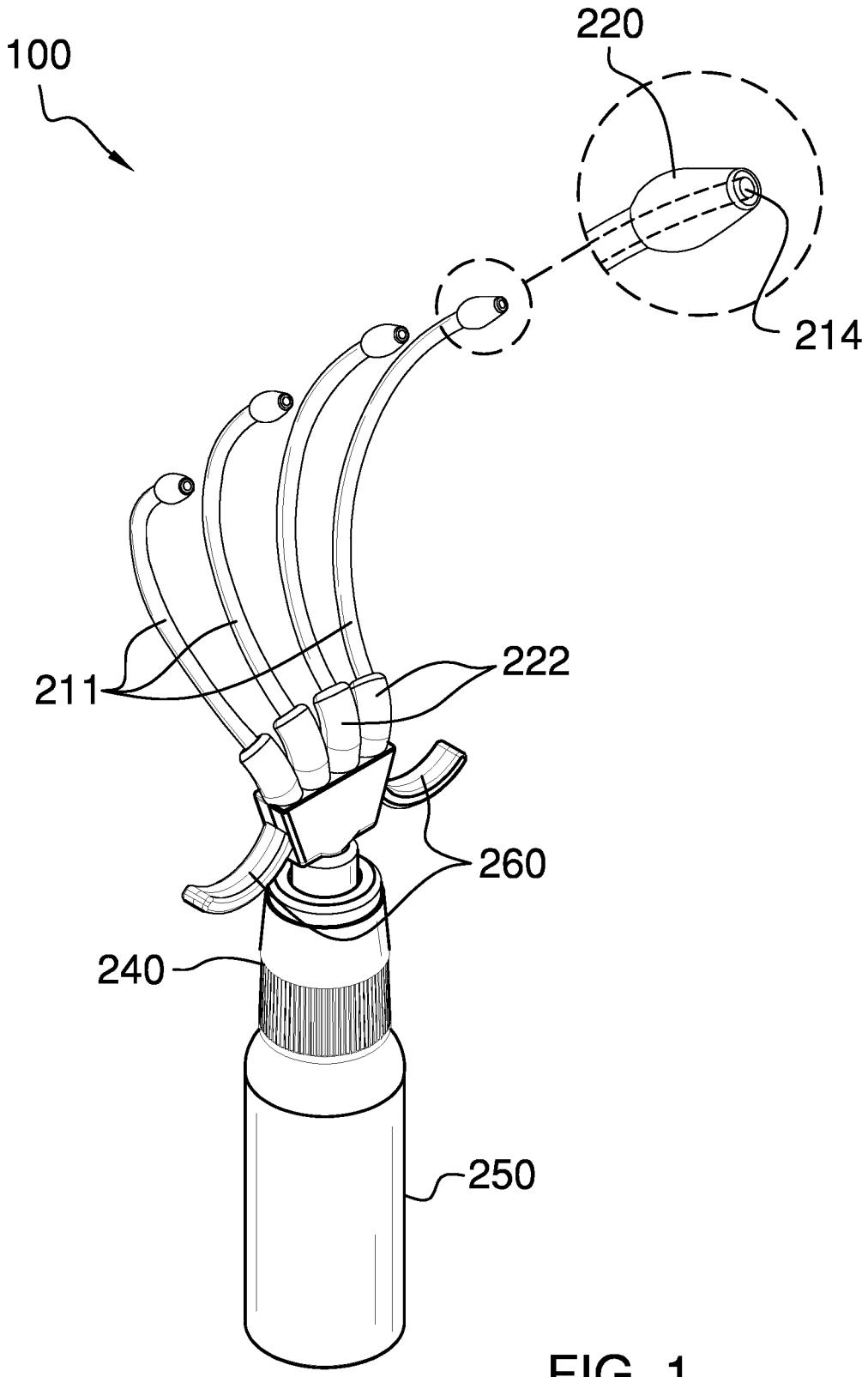
FIG. 1 is an isometric view of an embodiment of the disclosure.
Figure 2:
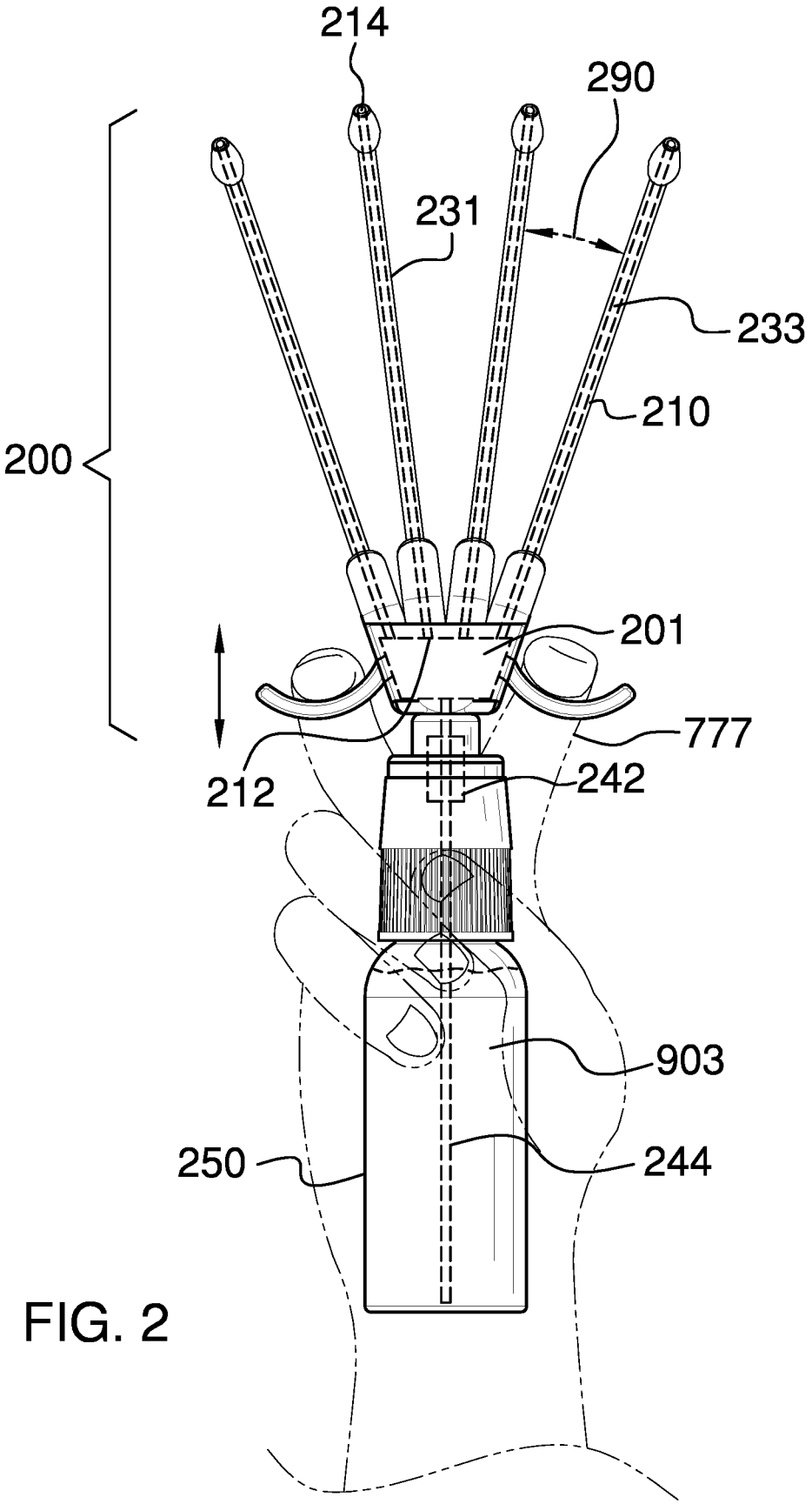
FIG. 2 is a front view of an embodiment of the disclosure.
Figure 3:
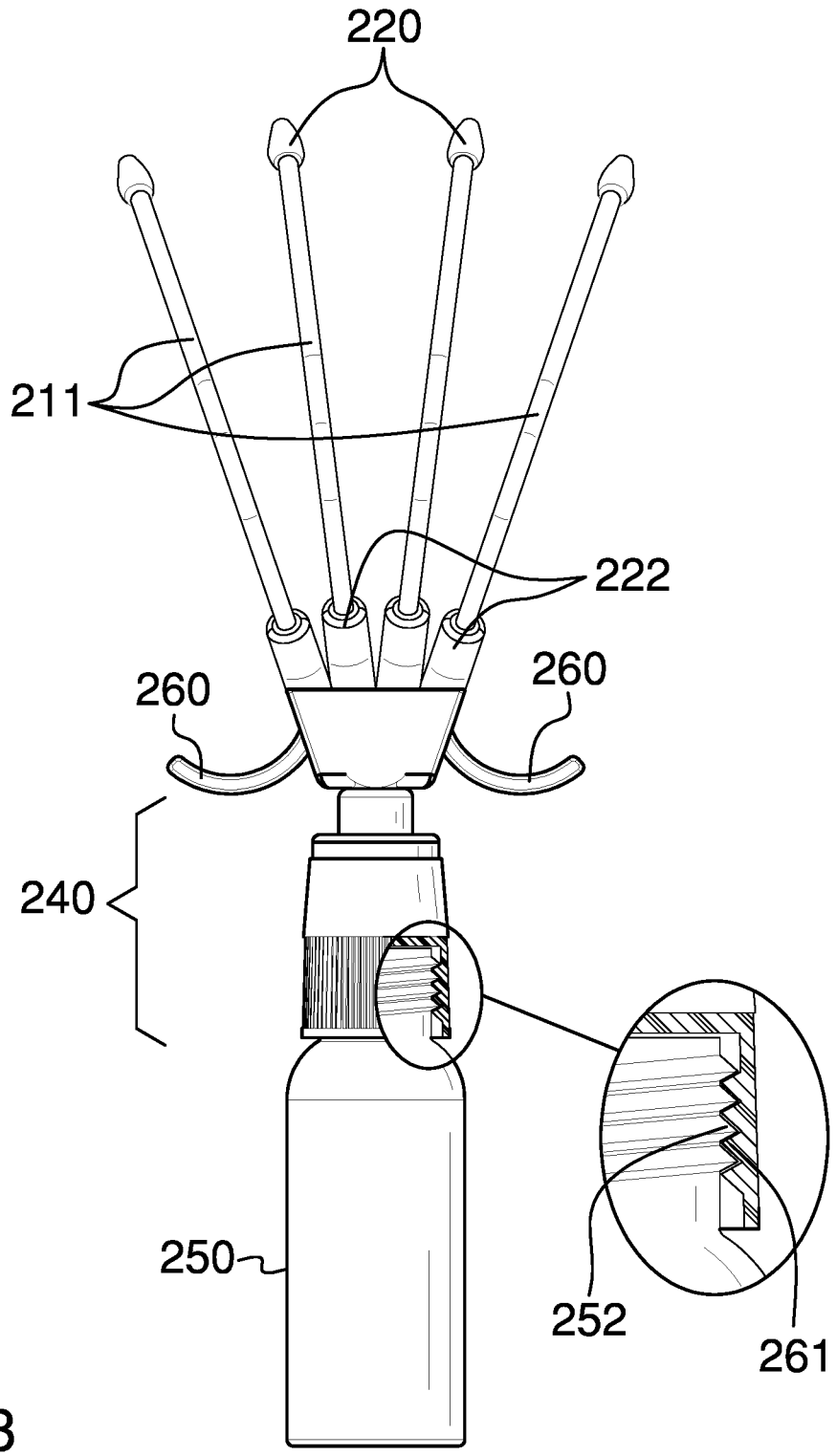
FIG. 3 is a rear view of an embodiment of the disclosure.
Figure 4:
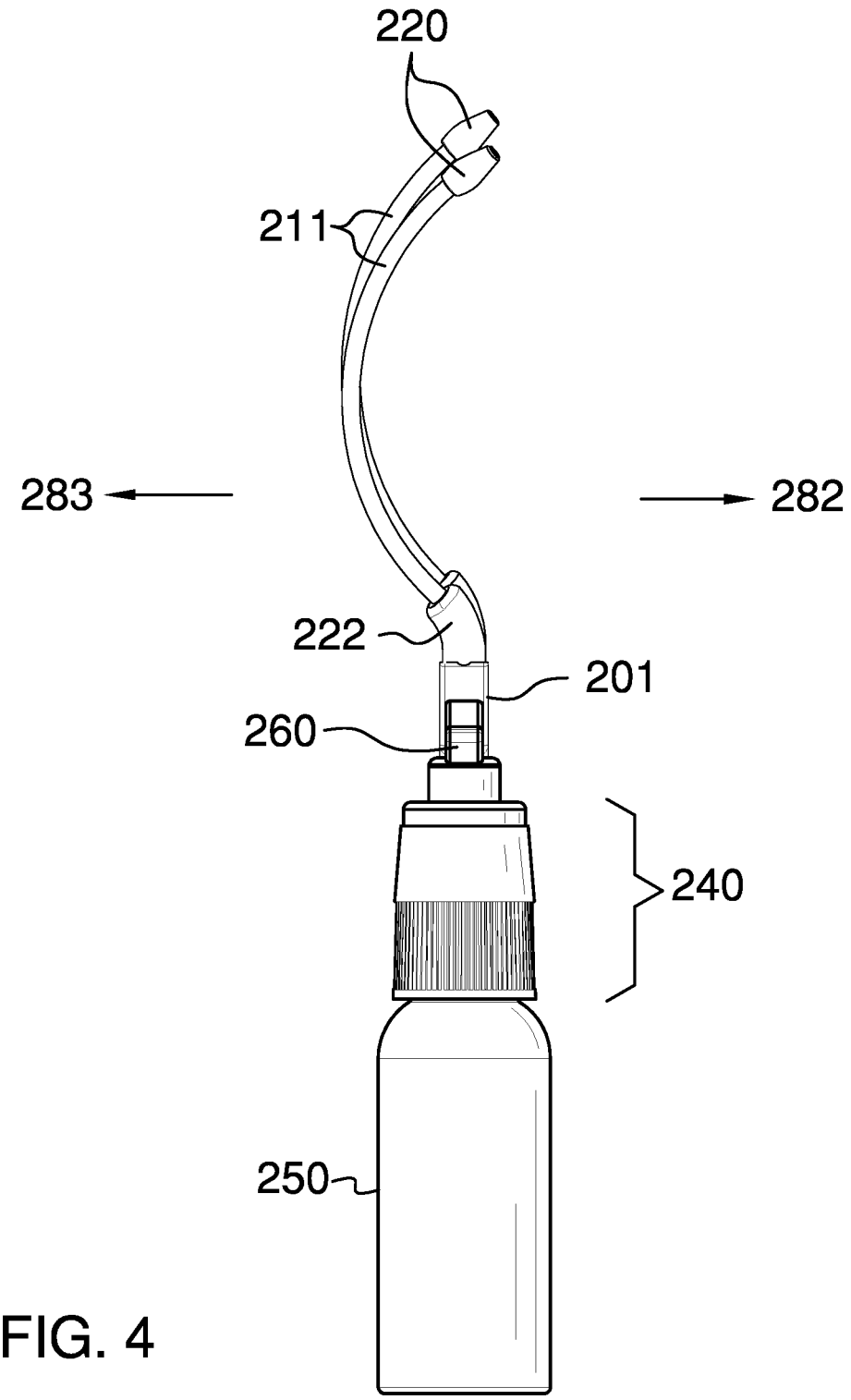
FIG. 4 is a side view of an embodiment of the disclosure.
Figure 5:
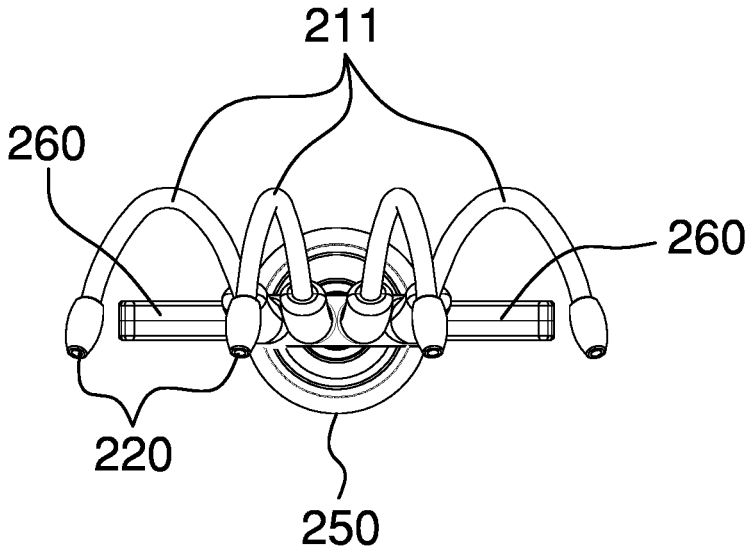
FIG. 5 is a top view of an embodiment of the disclosure.
Figure 6:
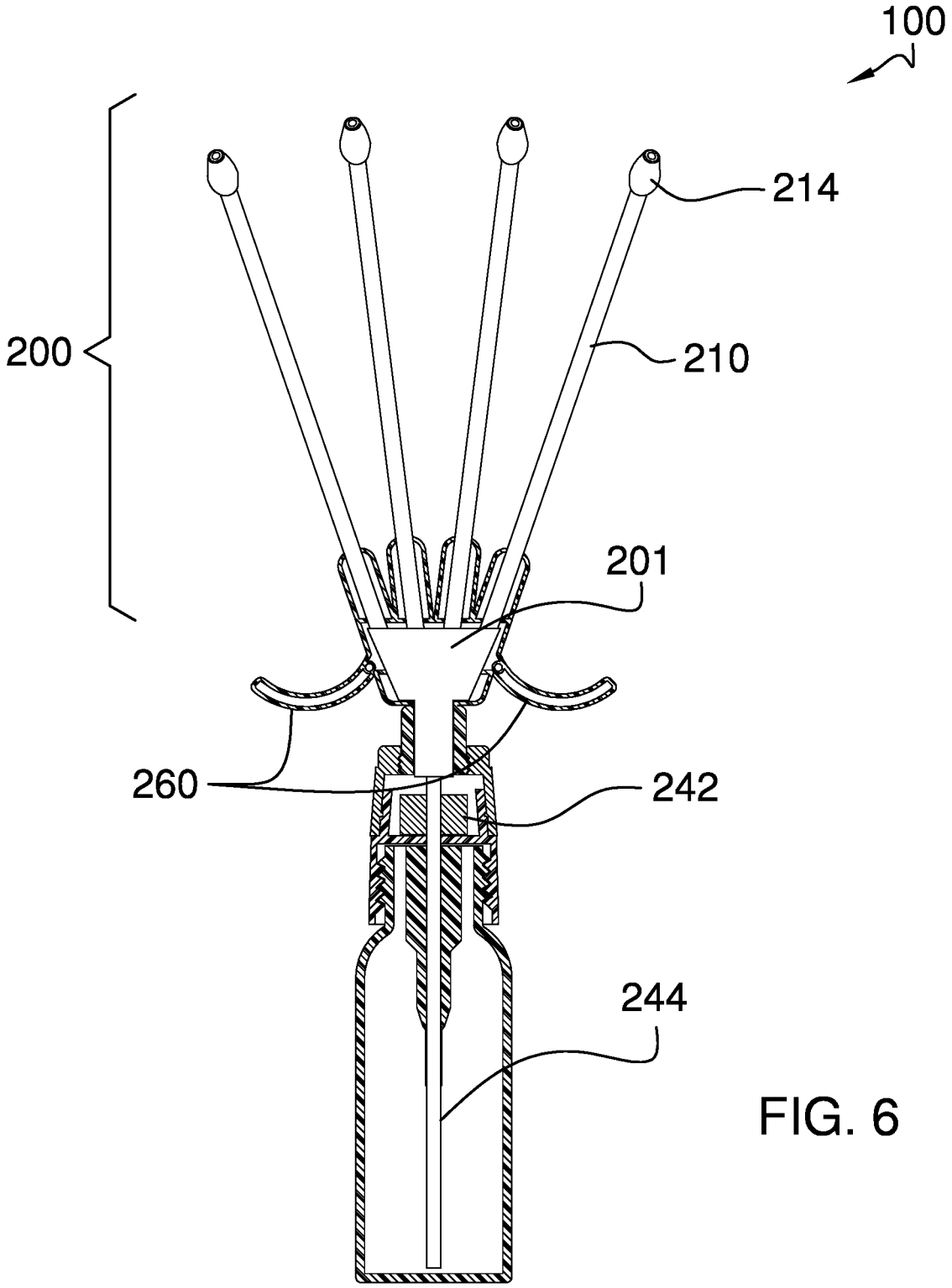

Detailed reference will now be made to a first potential embodiment of the disclosure, which is illustrated in FIGS. 1 through 5.

The scalp applicator 100 (hereinafter invention) comprises an applicator comb 200, a snapping cap 240, a solution container 250, and a pair of finger rests 260. The invention 100 is configured for use with a liquid phase cosmetic media 903. The invention 100 may be a tool that is adapted to apply the liquid phase cosmetic media 903 to a scalp of a patient. The pair of finger rests 260 may be adapted to be pulled by a user's fingers 777 while a user holds the solution container 250. Pulling the pair of finger rests 260 may activate a pump 242 to force the liquid phase cosmetic media 903 from the solution container 250 through the applicator comb 200 onto the scalp of the patient.

The applicator comb 200 may comprise a plurality of teeth 211, a plurality of teeth guides 222, and a manifold 201. The applicator comb 200 may be adapted to be inserted into hair of the patient such that the hair fits into diastemata between the plurality of teeth 211. The manifold 201 may form fluidic connections between a suction tube 244 and the plurality of teeth 211 and thereby distribute the liquid phase cosmetic media from the suction tube 244 to the plurality of teeth 211. The plurality of teeth 211 may be adapted to discharge the liquid phase cosmetic media 903 into the hair and onto the scalp of the patient.

The plurality of teeth 211 may form a fluidic distribution network of the invention 100. The plurality of teeth 211 may receive the liquid phase cosmetic media 903 under pressure from the manifold 201 and may transport the liquid phase cosmetic media 903 for discharge. In a preferred embodiment, there may be four (4) teeth.

An individual tooth 231 selected from the plurality of teeth 211 may comprise a hollow tube 210. The hollow center of the individual tooth 231 may comprise a transport channel 233 that transport the liquid phase cosmetic media 903 from a proximal tooth aperture 212 where the liquid phase cosmetic media 903 may enter the transport channel 233 from the manifold to a distal tooth aperture 214 where the liquid phase cosmetic media 903 may be discharged.

The plurality of teeth 211 may be splayed laterally to separate the plurality of teeth 211 and form the diastemata. A splay angle 290 between adjacent teeth may be established by the plurality of teeth guides 222. In a preferred embodiment, the splay angle 290 may be between 10.0 degrees and 16.0 degrees.

The plurality of teeth 211 may curve to form arcs such that the plurality of teeth 211 may touch the scalp of the patient simultaneously. The plurality of teeth 211 may be oriented by the plurality of teeth guides 222 to extend towards rear 283 and may then bend towards front 282 to form the arcs.

The distal end of the individual tooth 231 may be surrounded by a snag free tip 220. The snag free tip 220 may make the individual tooth 231 more comfortable by blunting the distal end of the individual tooth 231, may help exfoliate the scalp, help detangle the hair, or combinations thereof.

The manifold 201 may be a hollow structure. The manifold 201 may receive the liquid phase cosmetic media 903 under pressure from the pump 242 and distributes the liquid phase cosmetic media 903 to the plurality of teeth 211.

The snapping cap 240 may removably couple to the top of the solution container 250. The snapping cap 240 may be operable to activate the pump 242 when the snapping cap 240 is compressed by pulling the pair of finger rests 260 towards the solution container 250.

The pump 242 may be activated by compression. The pump 242 may draw the liquid phase cosmetic media 903 in from the solution container 250 through the suction tube 244 coupled to the bottom of the pump 242 when the pump 242 is activated. The pump 242 may force the liquid phase cosmetic media 903 out of the top of the pump 242 and into the manifold 201 when activated.

The bottom of the snapping cap 240 may comprise an interior thread 261 and the top of the solution container 250 may comprise an exterior thread 252. The interior thread 261 may complement the exterior thread 252 such that the snapping cap may threadedly couple to the solution container 250. The solution container 250 may be refilled by removing the snapping cap 240 from the solution container 250, by adding the liquid phase cosmetic media 903 to the solution container 250, and by threading the snapping cap 240 back onto the solution container 250.

The suction tube 244 may be a semi-rigid tube that extends downward from the pump 242 to the bottom of the solution container 250 such that the liquid phase cosmetic media 903 in the solution container 250 may be drawn into the pump 242 through the hollow center of the suction tube 244.

The solution container 250 may be a storage container for the liquid phase cosmetic media 903. In some embodiments, the solution container 250 may be transparent such that the level of the liquid phase cosmetic media 903 within the solution container 250 may be visible.

The pair of finger rests 260 may be adapted for the user's fingers to grasps while using the invention 100. The pair of finger rests 260 may be a pair of concave armatures locate on opposite lateral sides of the manifold 201. The pair of finger rests 260 may curve downwards to facilitate compression of the pump 242 by pulling down to compress the snapping cap 240.

In use, the solution container 250 may be filled with the liquid phase cosmetic media 903 by unscrewing the snapping cap from the solution container 250, filling the solution container 250 with the liquid phase cosmetic media 903, and screwing the snapping cap 240 back onto the solution container 250. The user may hold the solution container 250 in a hand and place their fingers onto the pair of finger rests 260. As a non-limiting example, the user may place an index finger and middle finger on the pair of finger rests 260 while the thumb and remaining fingers grasp the solution container 250. The snag free tips 220 at the ends of the plurality of teeth 211 may be positioned against the scalp of the patient. The plurality of teeth 211 may be moved through the patient's hair while the snapping cap 240 is compressed repeatedly by using the user's fingers to pull down on the pair of finger rests 260. As the snapping cap 240 is compressed, the pump 242 may be activated to pump the liquid phase cosmetic media 903 from the solution container 250, through the suction tube 244, into the manifold 201, and through the individual teeth 231. The liquid phase cosmetic media 903 may be dispensed from the distal tooth aperture 214 of each of the individual teeth 231 onto the scalp and the hair of the patient.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used in this disclosure, an "arc" may refer to a portion of a circumference or a curved perimeter. When applied to an angle, the arc also refers to a measure of an angular span as measured from a circle at the vertex formed by the sides of the angle.

As used in this disclosure, a "channel" may be a tubular passage through which an object or fluid is passed through.

As used herein, "complement" or "complementary" may refer to a compatibility between two threaded parts such that the gender, handedness, form, angle, pitch, diameter, and thread depth of both threads are compatible for the parts to mate by screwing the threads together.

As used in this disclosure, "cosmetic media" may refer to a chemical substance that is topically applied to a biological organism. The purposes for a cosmetic media include, but are not limited to: a) cleaning the skin and the hair of the biological organism; b) changing the visual, olfactory, and tactile stimuli presented by the biological organism to other nearby biological organisms; and, c) the topical application of a pharmacologically active media.

As used herein, the words "couple", "couples", "coupled" or "coupling", may refer to connecting, either directly or indirectly, and does not necessarily imply a mechanical connection.

As used in this disclosure, a "diastema" may be the space between two teeth.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, the word "exterior" may be used as a relational term that implies that an object is not located or contained within the boundary of a structure or a space.

As used herein, "filling", or "refilling", refers to the act of placing a first item into a second item whether the quantity of the first item fills the second item or not. As non-limiting examples, the first item may be a liquid, such as water or gasoline, or a granulated solid, such as sand or coffee beans. As non-limiting examples, the second item may be a bin, a bottle, a tank, or another type of container.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used in this disclosure, a "manifold" may be a pipe or chamber having several ports through which liquid or gas is gathered or distributed.

As used in this disclosure, a "patient" may be a person who is designated to receive a medical treatment, therapy, or service. The term patient may be extended to an animal when used within the context of the animal receiving veterinary treatment or services As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used herein, "resilient" or "semi-rigid" may refer to an object or material which will deform when a force is applied to it and which will return to its original shape when the deforming force is removed.

As used in this disclosure, a "tool" may be a device, an apparatus, or an instrument that is used to carry out an activity, operation, or procedure.

As used in this disclosure, "transparent" may refer to a material that allows light to pass through the material without significant scattering such that an object can be seen without distortion through the material. "Clear" may be considered to be both transparent and colorless.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention 8 is to be limited only by the scope of the following claims and their equivalents.

The inventors claim:

1. A scalp applicator comprising:

an applicator comb, a snapping cap, a solution container, and a pair of finger rests;

wherein the scalp applicator is configured for use with a liquid phase cosmetic media;

wherein the scalp applicator is a tool that is adapted to apply the liquid phase cosmetic media to a scalp of a patient;

wherein the pair of finger rests is adapted to be pulled by a user's fingers while a user holds the solution container;

wherein pulling the pair of finger rests activates a pump to force the liquid phase cosmetic media from the solution container through the applicator comb;

wherein the applicator comb comprises a plurality of teeth, a plurality of teeth guides, and a manifold;

wherein the applicator comb is adapted to be inserted into hair of the patient such that the hair fits into diastemata between the plurality of teeth;

wherein the manifold forms fluidic connections between a suction tube and the plurality of teeth and thereby distributes the liquid phase cosmetic media from the suction tube to the plurality of teeth;

wherein the snapping cap removably couples to a top of the solution container;

wherein the snapping cap is operable to activate the pump when the snapping cap is compressed by pulling the pair of finger rests towards the solution container.

2. The scalp applicator according to claim 1 wherein the plurality of teeth are adapted to discharge the liquid phase cosmetic media into the hair and onto the scalp of the patient.

3. The scalp applicator according to claim 2 wherein the plurality of teeth form a fluidic distribution network of the scalp applicator;

wherein the plurality of teeth receive the liquid phase cosmetic media under pressure from the manifold and transport the liquid phase cosmetic media for discharge.

4. The scalp applicator according to claim 3 wherein there are four teeth comprising the plurality of teeth.

5. The scalp applicator according to claim 3 wherein an individual tooth selected from the plurality of teeth comprises a hollow tube;

wherein the hollow tube at the center of the individual tooth comprises a transport channel that transports the liquid phase cosmetic media from a proximal tooth aperture where the liquid phase cosmetic media enters the transport channel from the manifold to a distal tooth aperture where the liquid phase cosmetic media is discharged.

6. The scalp applicator according to claim 5 wherein the plurality of teeth are splayed laterally to separate the plurality of teeth and form the diastemata;

wherein a splay angle between adjacent teeth is established by the plurality of teeth guides.

7. The scalp applicator according to claim 6 wherein the splay angle is between 10.0 degrees and 16.0 degrees.

8. The scalp applicator according to claim 6 wherein the plurality of teeth curve to form arcs;

wherein the plurality of teeth are oriented by the plurality of teeth guides to extend towards rear and then bend towards front to form the arcs.

9. The scalp applicator according to claim 8 wherein the distal end of the individual tooth is surrounded by a snag free tip;

wherein the snag free tip makes the individual tooth more comfortable by blunting the distal end of the individual tooth, exfoliates the scalp, detangles the hair, or combinations thereof.

10. The scalp applicator according to claim 9 wherein the manifold is a hollow structure;

wherein the manifold receives the liquid phase cosmetic media under pressure from the pump and distributes the liquid phase cosmetic media to the plurality of teeth.

11. The scalp applicator according to claim 10 wherein the pump is activated by compression;

wherein the pump draws the liquid phase cosmetic media in from the solution container through the suction tube coupled to the bottom of the pump when the pump is activated;

wherein the pump forces the liquid phase cosmetic media out of the top of the pump and into the manifold when activated.

12. The scalp applicator according to claim 11 wherein the bottom of the snapping cap comprises an interior thread and the top of the solution container comprises an exterior thread;

wherein the interior thread complements the exterior thread such that the snapping cap threadedly couples to the solution container.

13. The scalp applicator according to claim 12 wherein the solution container is refilled by removing the snapping cap from the solution container, by adding the liquid phase cosmetic media to the solution container, and by threading the snapping cap back onto the solution container.

14. The scalp applicator according to claim 13 wherein the suction tube is a semi-rigid tube that extends downward from the pump to the bottom of the solution container such that the liquid phase cosmetic media in the solution container is drawn into the pump through a hollow center of the suction tube.

15. The scalp applicator according to claim 14 wherein the solution container is a storage container for the liquid phase cosmetic media.

16. The scalp applicator according to claim 15 wherein the solution container is transparent such that the level of the liquid phase cosmetic media within the solution container is visible.

17. The scalp applicator according to claim 15 wherein the pair of finger rests is adapted for the user's fingers to grasp while using the scalp applicator;

wherein the pair of finger rests is a pair of concave armatures locate on opposite lateral sides of the manifold;

wherein the pair of finger rests curves downwards to facilitate compression of the pump by pulling down to compress the snapping cap.

* * * * *